US008366016B2

(12) United States Patent
Simpson

(10) Patent No.: US 8,366,016 B2
(45) Date of Patent: Feb. 5, 2013

(54) ADJUSTABLE WATER JET DEVICE

(75) Inventor: Richard Simpson, Tyrone, GA (US)

(73) Assignee: Custom Molded Products, Inc., Newnan, GA (US)

( * ) Notice: Subject to any disclaimer, the term of this patent is extended or adjusted under 35 U.S.C. 154(b) by 253 days.

(21) Appl. No.: 12/909,992

(22) Filed: Oct. 22, 2010

(65) Prior Publication Data

US 2011/0272492 A1 Nov. 10, 2011

Related U.S. Application Data

(63) Continuation-in-part of application No. 12/775,106, filed on May 6, 2010.

(51) Int. Cl.
*B05B 17/08* (2006.01)

(52) U.S. Cl. ..... 239/17; 239/16; 239/201; 239/562; 239/566; 239/569; 239/575; 239/587.4; 239/589

(58) Field of Classification Search ..... 239/16, 239/17, 201, 390, 396, 443, 562, 566, 569, 239/575, 587.4, 589
See application file for complete search history.

(56) References Cited

U.S. PATENT DOCUMENTS 3,292,861 A * 12/1966 Kawamura et al. ..... 239/17
3,690,554 A * 9/1972 Hruby, Jr. ..... 239/17
7,770,815 B2 * 8/2010 Green et al. ..... 239/587.4
8,042,748 B2 * 10/2011 Hagaman ..... 239/201

* cited by examiner

*Primary Examiner* — Steven J Ganey
(74) *Attorney, Agent, or Firm* — Laurence P. Colton; Smith Risley Tempel Santos LLC

(57) ABSTRACT

An adjustable water jet device so as to continuously regulate the velocity of water exiting the device without interrupting the water flow, the water jet device including a nozzle body, rotatable nozzle seat, a flow control plate, an inlet, and a nozzle eyeball configured to direct the water supply, and a water supply system including the adjustable water jet device, a plate for accommodating the water jet device in a pool deck or pool wall, and a cover that is mounted flush with the pool deck or pool wall.

8 Claims, 12 Drawing Sheets

ADJUSTABLE WATER JET DEVICE

CROSS REFERENCE TO RELATED APPLICATIONS

The present patent application claims the benefit of U.S. patent application No. 12/775,106 having a filing date of 6 May 2010, which is incorporated herein in its entirety by this reference.

BACKGROUND OF THE INVENTION

1. Technical Field

This invention generally relates to the field of adjustable water jet devices capable of controlling the flow of water supplied through a nozzle body for creating various arcing or angular, ornamental streams of water ultimately to be received by a water receptacle, and more specifically relates to the field of such adjustable water jet devices that can be adjusted without the use of a separate tool and while water is flowing through the device.

2. Prior Art

Water jet devices can create an ornamental stream of water into a water receptacle, such as a spa, pool, tub, or the like. The height and angle of the water stream emanating from the water jet device can be manipulated by adjusting the volume of the water supply via a valve and by adjusting the angular flow of the water supply via a nozzle eyeball. The water stream then is directed through an outlet of the device toward the water receptacle.

The prior art discloses ways to sustain a continuous water supply over an extended period of time to a desired location. For example, it is well-known to provide a water jet device for sending an arcing stream of water into a water receptacle. Such an arcing stream can be, for example, for functional purposes, such as for filling the water receptacle, or for aesthetic purposes, such as an ornamental arc of water, or for both. As known to those of ordinary skill in the art, when the water flow inside through a water jet device is reduced, the water flow leaving the water jet device also is reduced, and vice versa, and the height and length of the water arc can be adjusted. Additionally, the height and length of the water arc also can be adjusted by adjusting the position of the eyeball. Controlling the flow of water utilizing the above-mentioned principals is known in the prior art.

It also is known in the art that water jet devices can have a valve disposed therein which is movable in the axial direction of the device toward and away from an orifice by an external tool. The tool applies a rotational force in either a clockwise or a counterclockwise direction to a component of the water jet device causing displacement of the valve. As the valves moves closer to the orifice, the volumetric capacity decreases while the velocity, or flow, increases. As the valve moves further away from the orifice, the volumetric capacity increases while the water velocity leaving the water jet device decreases. For example, as mentioned in U.S. Pat. No. 7,770,815, delivering a preferred velocity of water to a predetermined area, such as a water receptacle, requires periodic calibration to continue delivering the same velocity of water to the same predetermined area.

U.S. Pat. No. 7,770,815 also suggests that a tool can be used to adjust the valve by contacting an adjustable component without having to disassemble and then reassemble components of the water jet device in order to adjust water flow. The tool is inserted into one end of the nozzle and rotated in order to transfer a rotational force to a valve which moves toward and away from an orifice. However, U.S. Pat. No. 7,770,815 does not suggest how to replace the nozzle eyeball with another type of nozzle eyeball in order to change the ornamental, angular design of the stream exiting the water jet device. U.S. Pat. No. 7,770,815 also does not suggest how to maintain a continuous flow of water during instances when the tool is adjusting the position of the valve in relation to the orifice. Specifically, when adjusting the valve in U.S. Pat. No. 7,770,815, the flow of the water arc is interrupted or interfered with.

It can be seen that there is a need for a mechanism for a water jet to facilitate efficient replacement of the nozzle eyeball and to change the angular, ornamental flow of water emanating from the water jet in accordance with the handler's aesthetic demand. Also needed is an adjustable mechanism capable of adjusting the velocity of water running through the device while maintaining a continuous water supply exiting the device. Moreover, an adjustable water jet device that reduces downtime during replacement of the nozzle eyeball is desired. Further, a compact water jet device that takes up less space in a pool wall or pool deck is desired.

SUMMARY OF THE INVENTION

Briefly, the present invention is a water jet device configured to supply water at a predetermined velocity, which can be adjusted by the user, to a water receptacle. Namely, the present invention is capable of adjusting the velocity and flow of water into a water receptacle, and forming a water arc, without having to utilize an external tool and without interrupting the flow of water through the device, that is, without having to turn the water flow off while adjusting the velocity and flow of water through the device. More specifically, the present invention is capable of adjusting the water supply while continuously supplying water toward a water receptacle.

The water jet device includes a nozzle body, a nozzle seat, a water supply conduit, a flow control plate, and a nozzle eyeball for regulating the type of water flow exiting the device. The water jet device includes a first end that accommodates the supply conduit for the water supply to enter the device. The second end of the water jet device is disposed at a top surface of the nozzle eyeball from which the water supply exits the water jet device to be supplied to a water receptacle.

The nozzle seat is disposed within the nozzle body. The nozzle seat includes a bottom wall having at least one and preferably a plurality of holes disposed therein. The nozzle seat is capable of being rotated.

The flow control plate is disposed between the supply conduit and the nozzle seat, and proximal to the bottom wall of the nozzle seat. In a preferred embodiment, the flow control plate preferably remains static during operation of the water jet device. The flow control plate also has at least one and preferably a plurality of holes disposed therein that cooperate with the at least one or plurality of holes disposed in the nozzle seat for affecting the flow of water through the nozzle.

The nozzle seat component is rotated with respect to the flow control plate. Rotation can be performed in either a clockwise or a counterclockwise direction. By so doing, the respective hole(s) of the nozzle seat and the flow control plate can be aligned, partially aligned, or not aligned with one another. The rotatable hole(s) of the nozzle seat cooperating with the non-rotatable hole(s) of the nozzle body allow for the water flow through the adjustable water jet device to be adjusted via a compact structure.

Water flowing through the hole(s) in the flow control plate and the nozzle seat then can flow through an optional sponge, which removes debris from the water flow and reduces turbulence in the water flow. The water then flows into and through the nozzle eyeball, which is disposed within the nozzle seat. The nozzle eyeball is fastened to the nozzle seat by a lock ring. The nozzle eyeball can be adjusted to a myriad of position for directing the water flow, as a water arc, into the water receptacle.

The water jet device also includes a plurality of handles located on an outer wall of the nozzle body. The handles preferably allow a user to insert and remove the water jet device within the jet body mounted on or near the water receptacle without having to contact any components located within a circumference defined by the nozzle body, such as the nozzle eyeball and the nozzle seat. The nozzle body preferably is threadedly attached to the jet body for ease of insertion and removal.

In addition, the water jet supply system includes a cover that substantially covers the second section of the water jet device. The cover is fitted so as to be easily removed when disassembling, adjusting the water flow, interchanging nozzle eyeballs, or performing maintenance. The cover is mounted flush with the pool deck or pool wall.

One feature of the present invention is to provide a water jet device that is capable of maintaining a continuous flow during adjustment of the water supply through the device. Another feature of the present invention is to provide a water jet device that does not require an external tool for adjusting the flow of water supply. Yet another feature of the present invention is to provide a water jet device that is easy to assemble and disassemble and provides easy interchanging of nozzle eyeballs independently from a flow adjusting mechanism. Still another feature of the present invention is to provide a water jet system for implementation in a pool deck or pool wall to convey an ornamental water supply into a water receptacle.

DETAILED DESCRIPTION OF THE PREFERRED EMBODIMENTS

Figure 1:
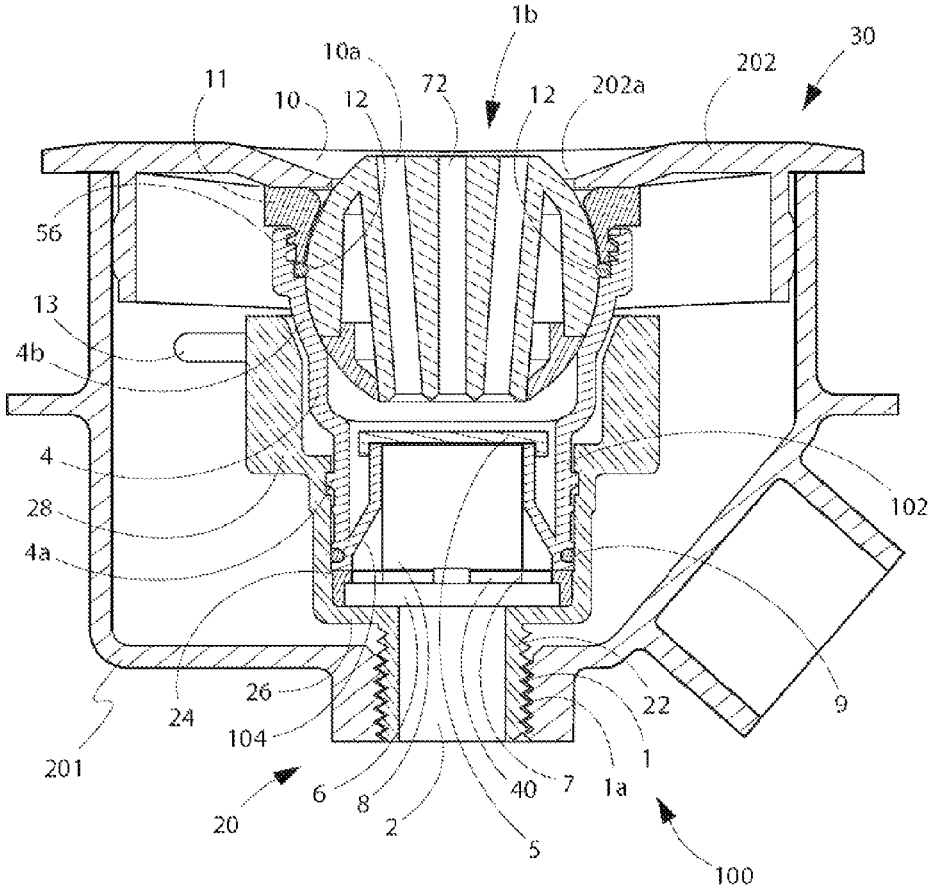
FIG. 1 is a detailed perspective view of an embodiment of an adjustable water jet device according to the present invention.

The figures are illustrative of an embodiment of an adjustable water jet device 100. Similar reference numerals are used in the various figures to represent like parts throughout the several views.

Referring now to FIG. 1, the adjustable water jet device 100 includes a first end 20 and a second end 30. The first end 20 is capable of accommodating a water supply for supplying water into the water jet device 100. The water supply exits the water jet device 100 from the second end 30 through a nozzle 10, such as an eyeball nozzle, at a specified angle and velocity, resulting in a water arc 402, to be received by a water receptacle 400.

The device 100 includes a tubular-shaped nozzle body 1 extending from the first end 20 toward the second end 30. The nozzle body 1 can generally be formed from any material, including but not limited to plastic, wood, ceramic, composites, alloys, or stainless steel. Nozzle body 1 preferably is a hollow molded pre-form. Nozzle body 1 includes a hollow tubular first section 22 having a threaded area la on the outer wall originating from the first end 20 of the device 100 in order to provide a secure yet removable attachment within jet body 201. Jet body 201 is mounted on or near the water receptacle 400. Nozzle body 1 also includes a hollow tubular second section 24, preferably having a diameter larger than the diameter of the first section 22. The transition between the first section 22 and the second section 24 forms a shoulder 26. Nozzle body 1 also can include a hollow tubular third section 28 attached to the end of the second section 24 distal from the first section 22. Alternatively, the third section 28 can be an extension of the second section 24.

The first section 22 of nozzle body 1 circumferentially encloses and supports a supply conduit 2 formed therein which extends in the axial direction from the first end 20 of the device 100 toward the second end of the device 100. An external water supplying pipe (not shown) can be attached to the first end 20 of nozzle body 1, at the first section 22 and distal from the second end 30. Water thus is supplied to the device 100 through the first section 22.

A flow control plate 6 rests upon shoulder 26, and preferably is securely and immovably attached to shoulder 26, between the first section 22 and the second section 24. Preferably, flow control plate 6 is a static component. Flow control plate 6 is oriented in a direction transverse to the axial direction of the water jet device 100. The outer edges of flow control plate 6 are accommodated by an inner wall of nozzle seat 4 in a circumferential manner, within the inner wall of nozzle body 1, and below (upstream of) the lower wall of nozzle seat 4 having hole(s) 40 formed therein. Preferably, flow control plate 6 is located above a circumferential area of the threaded outer wall 1*a* of nozzle body 1.

Flow control plate 6 includes at least one and preferably a plurality of holes 60 formed therethrough. Hole(s) 60 extend from an upper edge to a lower edge of flow control plate 6, from a position near the center of flow control plate 6 toward a periphery of flow control plate 6. In a preferred embodiment, hole(s) 60 can be pie-shaped so as to better fit the dimensions of the flow control plate 6, but also can be of any shape, and are located equidistant from one another. Preferably, there are two holes 60 in the flow control plate 6 and each hole 60 is disposed at an angle of 180° from (diametrically opposite) the other hole 60, but three or more holes 60 can be used, preferably located equi-angularly from each other.

Nozzle seat 4 comprises first section 42 and second section 44, the first section 42 being proximal to the flow control plate 6 and the second section 44 being proximal to the cover 202. At least a portion of the nozzle seat 4 fits within and is supported by the nozzle body 1, preferably within the second section 24 and the third section 28 of the nozzle body 1 above (downstream of) the flow control plate 6. Preferably, the nozzle seat 4 is disposed adjacent to an inner wall of the nozzle body 1. The nozzle seat 4 preferably is tubular-shaped and extends in the axial direction of the device 100. The nozzle seat 4, having a first end 4*a*, extends from the flow control plate 6 toward the second end 30 of the device 100. Preferably, the nozzle seat 4 substantially extends above an upper end 1*b* of the nozzle body 1 to a second end 4*b* of the nozzle seat 4. As discussed in more detail below, the nozzle seat 4 is rotatably secured within the nozzle body 1, comprises a lower (upstream) end comprising holes 40 that cooperate with the holes 60 through the control flow plate 6, supports an optional filter and turbulence reducing sponge 8, and holds the nozzle 10, in this axial (linear) upstream to downstream order.

Figure 4:
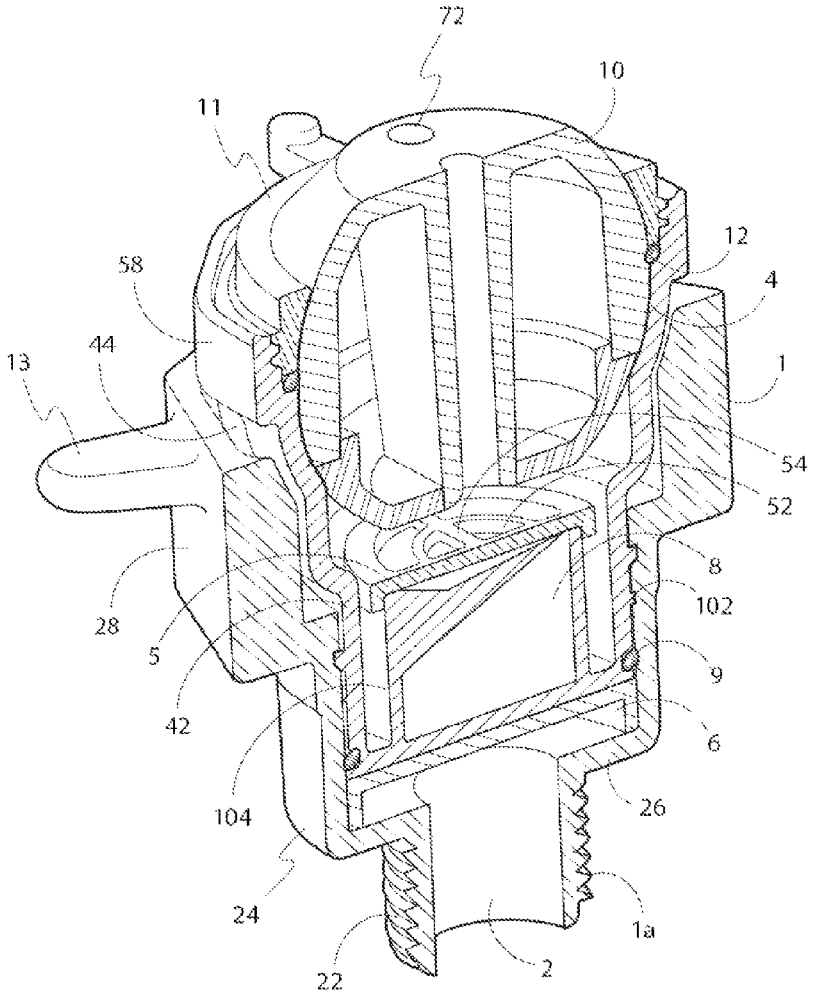
FIG. 4 is a cross-sectional view of the adjustable water jet device shown in FIGS. 2 and 3 illustrating one position of the nozzle seat in relation to the nozzle body.

Nozzle seat 4 comprises a bottom wall 7 transversely disposed in the axial direction of the device 100, a tubular outer wall 102, and an optional tubular inner wall 104 that is preferably concentric with outer wall 102. As shown in FIG. 4, an optional but preferable sponge 8 is disposed within an area defined by inner wall 104. The volume V defined by inner wall 104 ends downstream at a rim, which can be enclosed by a cap 5, such that a lower surface of cap 5, inner walls 104 of nozzle seat 4, and an upper surface of the bottom wall 7 define the volume V for containing sponge 8.

Bottom wall 7 has a plurality of holes 40 formed therein. As shown, these holes 40 can be pie-shaped, but also can be of any shape. Preferably, holes 40 are located equidistantly from one another about bottom wall 7. Preferably, the bottom surface 40 has two holes located 180 degrees from (diametrically opposite) one another, but three or more holes 40 can be used, preferably located equi-angularly from each other. Holes 40 and holes 60 preferably are present in equal numbers to each other, are similarly shaped to each other, and cooperate with each other to allow, partially allow, or prevent water from flowing from supply conduit 2 to the interior of nozzle seat 4. Cap 5 has a hole or holes 52 therethrough to allow water to exit the volume V containing sponge 8 and to flow to nozzle 10.

Nozzle seat 4 is sealably connected to nozzle body 1 via a seal ring 9, which can be an O-ring. FIG. 6 exemplifies the seal ring 9 located between an outer wall of the nozzle seat 4 and an inner wall of nozzle body 1. In an alternative embodiment, seal ring 9 engages a recessed portion of the inner wall of the nozzle body 1. Seal ring 9 helps prevent water from flowing between nozzle seat 4 and nozzle body 1 such that most if not all of the water entering the device 100 flows through nozzle 10. Additionally, various know structural features can be used to maintain nozzle seat 4 within nozzle body 1 yet allow nozzle seat 4 to rotate within nozzle body 1.

Nozzle seat 4 is capable of being rotated either manually or, in alternative embodiment, by a rotating mechanism or element (not shown), within nozzle body 1. Rotation can be either in the clockwise or counterclockwise direction. The rotating mechanism is preferably controlled by a controller (not shown) having set instructions to adjust the location of nozzle seat holes 40 and flow control plate holes 60 in relation to one another depending upon a desired water supply. As will be explained in detail herein, rotation of nozzle seat holes 40 controls the volumetric flow of the water supply through the device 100.

Eyeball nozzle 10 is housed within nozzle seat 4, preferably the second section 44 of nozzle seat 4. Eyeball nozzles 10 are known in the art. The upper surface 10*a* of eyeball nozzle 10 is located at a second end 30 of the device 100. Eyeball nozzle 10 is interchangeable. Preferably, different nozzle styles used in this device 100 include, but are not limited to, a spinner, double stream, triple stream and fan-shaped nozzles.

Eyeball nozzle 10 is movably held in nozzle seat 4 by a lock ring 11 that is located around the circumference of eyeball nozzle 10. Lock ring 11 is attached either integrally or non-integrally to nozzle seat 4. Locking ring 11 can maintain eyeball nozzle 10 within nozzle seat 4 in a manner that allows eyeball nozzle 10 to pivot and rotate within nozzle seat 4. Alternatively, locking ring 11 can maintain eyeball nozzle 10 within nozzle seat 4 in a non-movable manner. O-ring 12 can be located between locking ring 11 and the inner wall of nozzle seat 4 to prevent water from flowing around nozzle 10, such that most if not all of water flows through nozzle 10. Also, any of a plurality of o-rings or seal rings 9, 12 can be used to seal any of the above-identified components in relation to one another.

Thus, in view of the present invention, eyeball nozzle 10 can be easily replaced with another nozzle capable of supplying a water supply having different angular flow characteristics. This configuration of interchangeable nozzle 10 eliminates the need to disassemble the arrangement of nozzle seat 4 in relation to flow control plate 6, which is designed to regulate the velocity of the water supply. Hence, downtime is significantly reduced.

Figure 2:
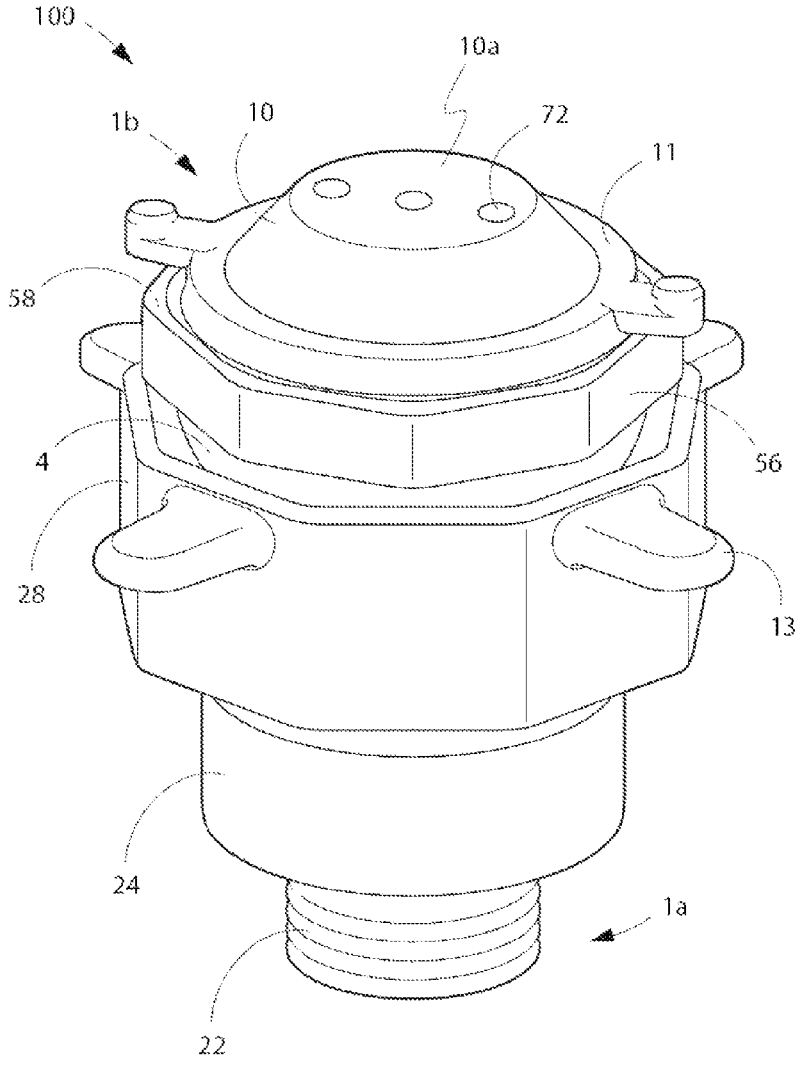
FIG. 2 is a perspective view of the adjustable water jet according to the present invention.

FIG. 2 is a perspective view of the water jet device 100. A plurality of handles 13 protrude from nozzle body 1 in a direction transverse to the axial direction of the device 100. As preferably shown, four handles extend from nozzle body 1. Handles 13 can be used to insert and remove nozzle body 1 from jet body 201. The upper outer rim 56 of nozzle seat 4 also is shown in more detail. Optional protuberances 58 allow nozzle seat 4 to be more easily rotated so as to align, partially align, or unalign nozzle seat holes 40 with flow control plate holes 60, as disclosed in more detail in connection with FIGS. 5 and 7. Protuberances 58 can be bumps, ridges, handles, or any other suitable structure to assist the user in rotating nozzle seat 4.

Figure 3:
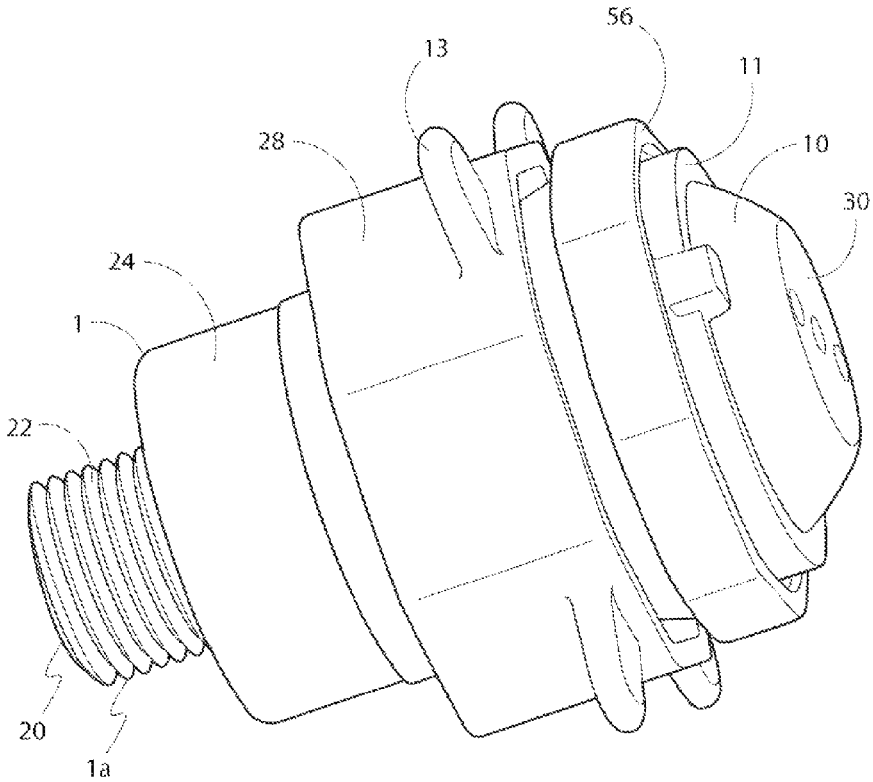
FIG. 3 is another perspective view of the adjustable water jet device in FIG. 2 further illustrating the edges of the device and the threaded first end of the nozzle body.

FIG. 3 is another perspective view of the water jet device 100. In this illustration, the threaded end la of nozzle body 1 covers supply conduit 2 at located at the first end 20 of the device 100. At the second end 30 of the device 100 is eyeball nozzle 10. This view shows in more detail the structural relationship of the various parts of the device 100 relative to each other.

FIG. 4 is a cut-away view perspective in the axial direction of the device 100. Specifically, nozzle seat 4 is shown as being rotatable within nozzle body 1. In this illustration, sponge 8 also can be seen. Cap 5 can be seen in more detail, and specifically the holes 52 or passages through cap 5 to allow water to flow from volume V containing sponge 8 into nozzle 10. Retaining bars 54 maintain sponge 8 within volume V containing sponge 8 and add structural rigidity to cap 5. Lock ring 11 also can be seen in more detail, and may be used to securely fasten eyeball nozzle 10 within an upper end of nozzle seat 4. Lock ring 11 can have a screw fitting relative to nozzle seat 4, to secure lock ring 11 on nozzle seat 4, with lock ring 11 having a male component and nozzle seat 4 having a female component, or vice versa. Alternatively, lock ring 11 can have a snap fitting relative to nozzle seat 4, with lock ring 11 having a male component and nozzle seat 4 having a female component, or vice versa.

Figure 5:
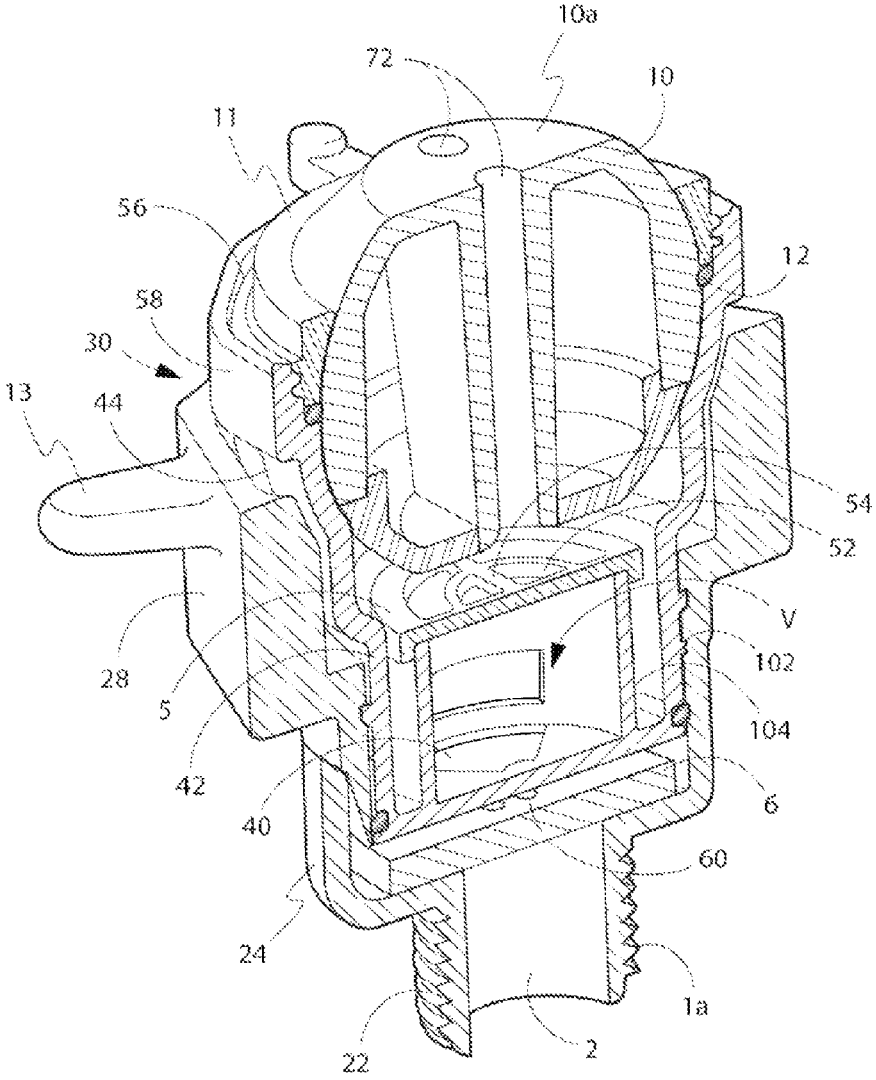
FIG. 5 is a cross-sectional view of the adjustable water jet device shown in FIGS. 2 and 3 illustrating another position of the nozzle seat in relation to the nozzle body.

FIG. 5 is another cut-away perspective view in the axial direction of the device 100 without sponge 8 or with sponge 8 removed. Specifically, nozzle seat 4 is shown as being rotatable and having a plurality of holes 40, which can be seen in more detail on bottom wall 7 of nozzle seat 4.

Figure 6A:
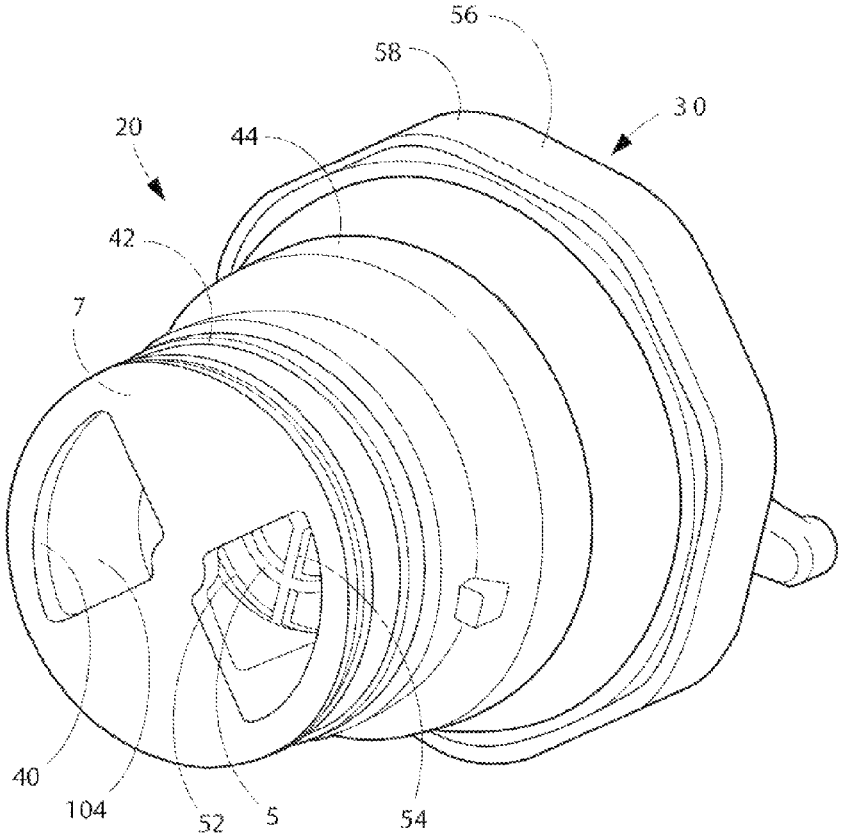
FIG. 6A is a perspective view of the nozzle seat illustrating holes formed in its bottom surface.

FIG. 6A is an illustration of the nozzle seat 4 providing more detail of holes 40. In particular, this example of bottom wall 7 of nozzle seat 4 is shown as having two holes 40 formed therein.

Figure 6B:
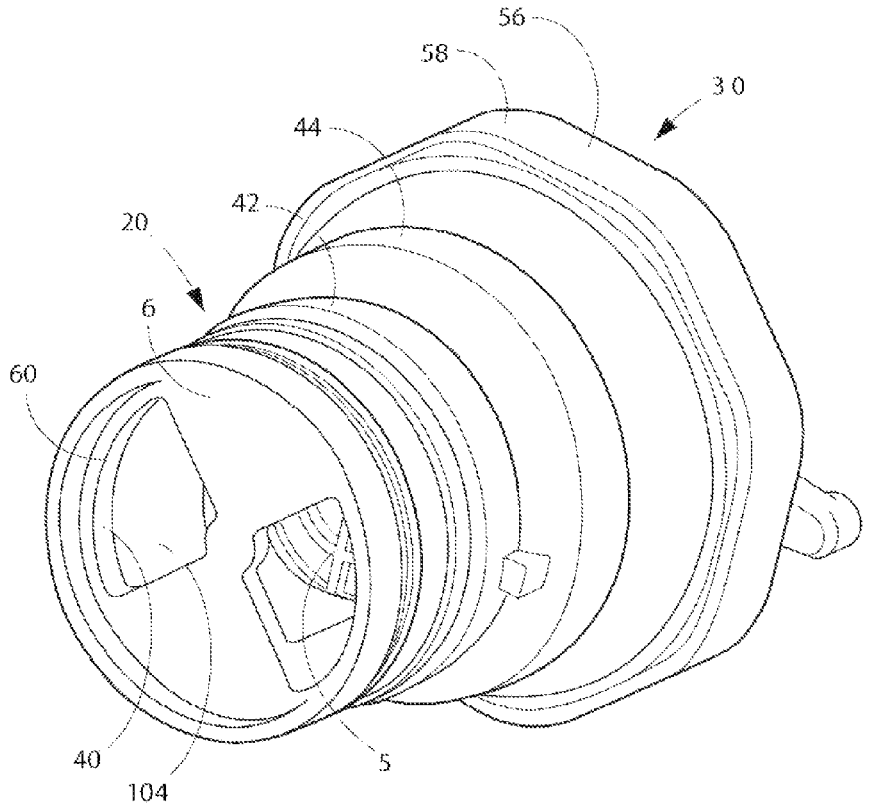
FIG. 6B is a perspective view of the nozzle seat shown in FIG. 6A showing the physical relationship of the control plate to the nozzle seat.

FIG. 6B is a perspective view of nozzle seat 4 shown in FIG. 6A showing the physical relationship of flow control plate 6 to nozzle seat 4. In this example embodiment, the two holes 40 are pie-shaped. In this view, flow control plate holes 60 are aligned with nozzle seat 4 holes 40. Nozzle seat 4 rotates relative to flow control plate 6 as disclosed in more detail in connection with FIG. 7.

Figure 7:
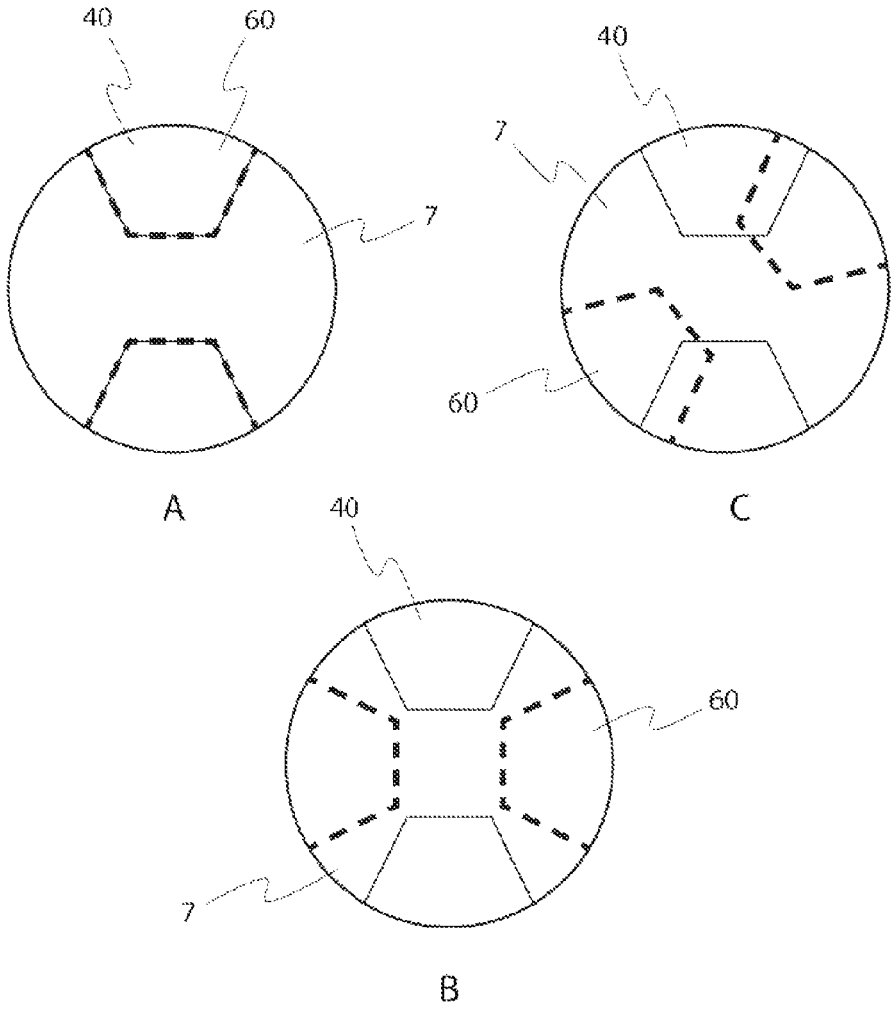
FIGS. 7A, 7B and 7C illustrate various positions in the circumferential direction of the nozzle seat holes in relation to the flow control plate holes.

FIG. 7 shows various control flow configurations of nozzle seat holes 40 relative to flow control plate holes 60. Nozzle seat holes 40 are illustrated by the solid lines and flow control plate holes 60 are illustrated by the dotted lines. Nozzle seat 4 is capable of being rotated in either direction, clockwise or counterclockwise, causing nozzle seat holes 40 to be set in relation to flow control plate holes 60. Preferably, flow control pate 6 remains fixed and therefore, flow control plate holes 60 also remain fixed, with nozzle seat holes 40 rotating relative to flow control plate holes 60.

FIG. 7A, illustrates nozzle seat holes 40 being completely coincident with flow control plate holes 60 allowing for a maximum flow or stream of water to pass through the device 100. When holes 40, 60 entirely coincide, the volume of the water stream entering nozzle 10 and then exiting the device 100 is at a relative maximum and the device 100 can be considered in the full "on" position.

FIG. 7B illustrates nozzle seat holes 40 being completely divergent from flow control plate holes 60 allowing for a minimum or no flow or stream of water to pass through the device 100. That is, no part of nozzle seat holes 40 are aligned with flow control plate holes 60. In this configuration, the water supply entering nozzle 10 and then exiting the device 100 is at or near zero, and the device 100 can be considered in the "off" position.

FIG. 7C illustrates nozzle seat holes 40 being partially aligned with flow control plate holes 60 allowing for a partial flow or stream of water to pass through the device 100. This illustration is exemplary of any alignment between nozzle seat holes 40 and flow control plate holes 60 other than the configuration of being completely coincident or completely divergent from each another. Hence, the velocity of water can range anywhere between an absolute maximum or an absolute minimum. When holes 40, 60 partially coincide, the volume of the water stream entering nozzle 10 and then exiting the device 100 is between a relative maximum and a relative minimum (or zero) and the device 100 can be considered in the partial "on" position.

Figure 8:
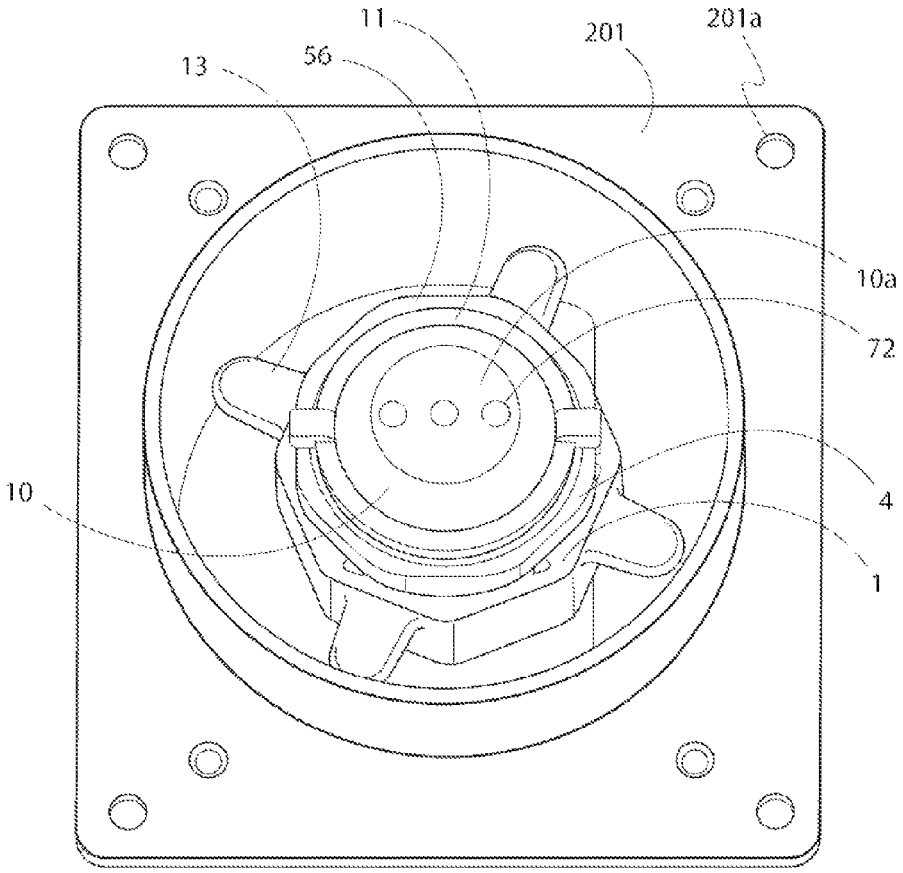
FIG. 8 illustrates the adjustable water jet device in a plate within a cavity of a pool deck or pool wall.
Figure 11:
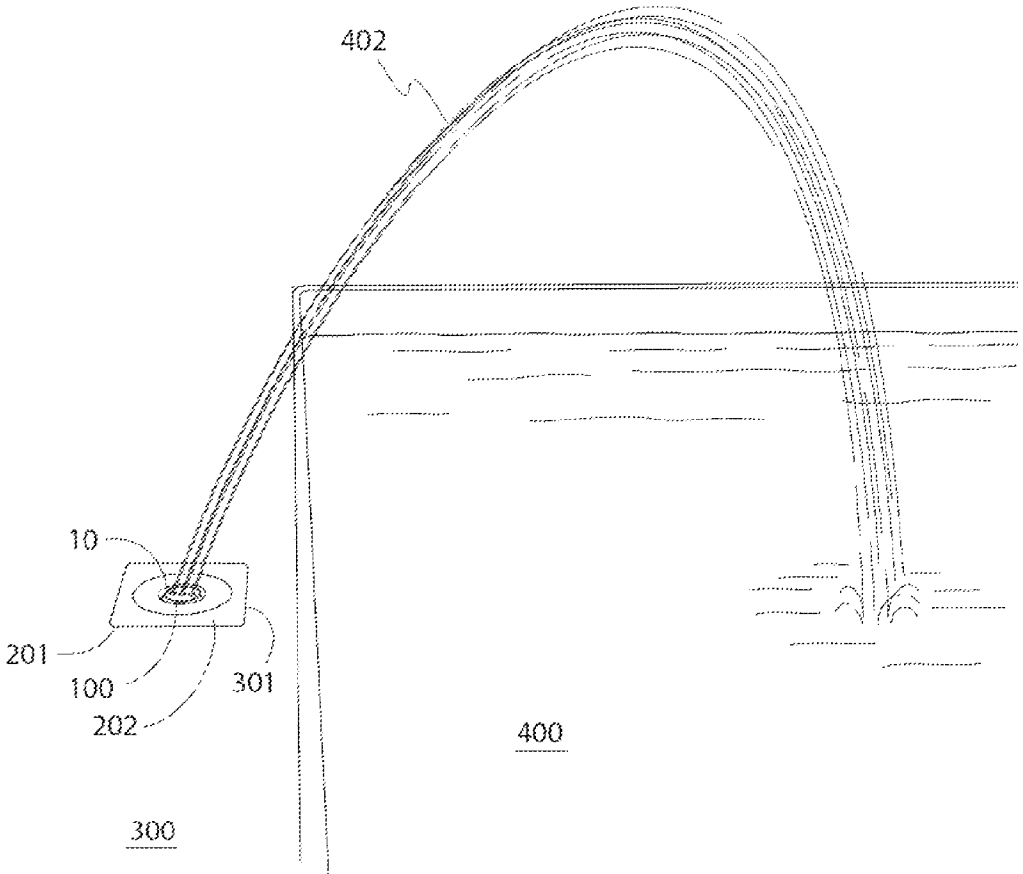
FIG. 11 illustrates the adjustable water jet device installed in a pool deck or pool wall and a supply of an ornamental water stream to an adjacent swimming pool.

FIG. 8 is an illustration of the water jet supply system 200 wherein the water jet device is disposed within jet body 201. Jet body 201 is preferably made of, but not limited to, plastic or metal. Jet body 201 is housed within a cavity or recess 301 of the water receptacle deck or wall 300, as shown in FIG. 11. The structural relationship between nozzle 10, lock ring 11, nozzle seat 4, nozzle body 1, and jet body 201 can be seen in greater detail. As can be seen, nozzle seat 4 rim 56 and protuberances 58 are accessible to a user for rotating nozzle seat 4 relative to flow control plate 6 for adjusting the flow through the device 100. As also can be seen, locking ring 11 and handles 13 are accessible to a user for ease of removing and replacing nozzle 10 and nozzle seat 4, respectively. Jet body 201 can include a plurality of holes 201*a* formed near its periphery to fasten the plate 201 to the recessed portion 301 of deck or wall 30 illustrated in FIG. 11. Fasteners may include, but are not limited to, screws bolts and other means for stabilizing the plate within the pool deck or pool wall 300.

In FIG. 8, the water jet device 100 of the water jet device system 200 also includes a plurality of handles 13 located on an outer wall of nozzle body 1. Handles 13 preferably allow a user to orient and replace the water jet device 100, or in some instances, only nozzle eyeball 10 component, located within plate 201. This allows for minimal contact by a user with the water jet device 100, especially nozzle eyeball 10 and nozzle seat 4 used for fixing the angle and velocity of the water flow.

Figure 9:
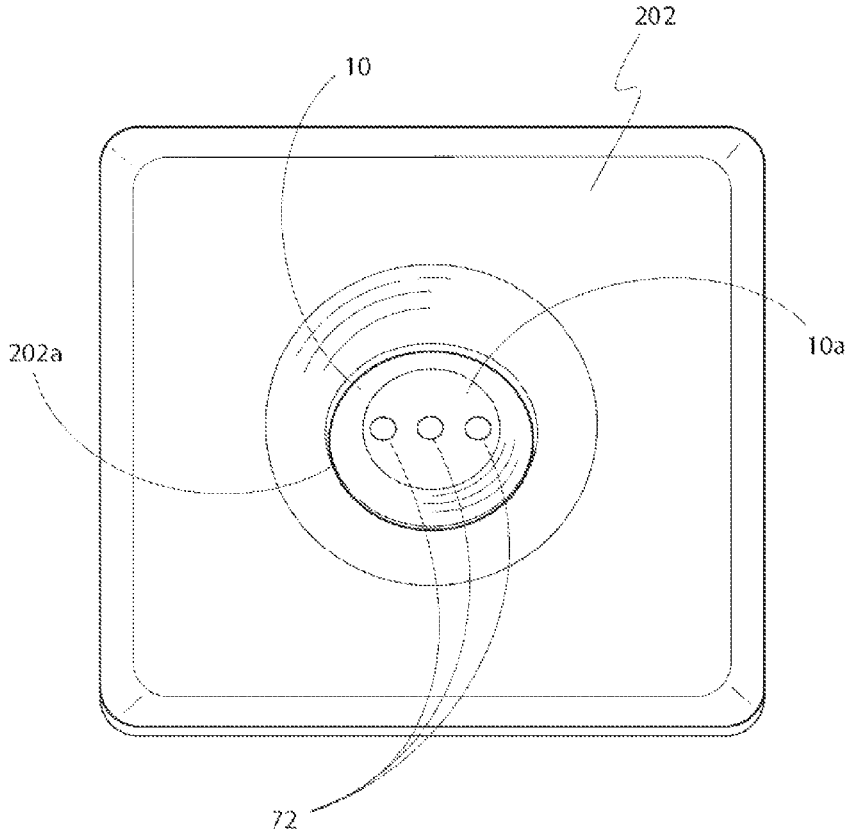
FIG. 9 illustrates the cover of the pool deck system.

FIG. 9 illustrates a cover 202 that can be included in the water jet supply system 200 that covers the second section 30 of the water jet device 100. Cover 202 is fitted so as to easily be removed when adjusting the nozzle 10 arc, adjusting the water flow rate through the device 100, disassembling the device 100, interchanging eyeball nozzles 10, or maintaining the system. Cover 202 is mounted flush with the deck or wall 300. Cover 202 is typically aesthetically fitted to provide a finished look to the deck or wall 300. Cover 202 typically can be any shape so long as it covers cavity 301 in the deck or wall 300. Cover 202 preferably is substantially planar so as to be flushly mounted with the deck or wall 300. Cover 202 includes a hole 202*a* located at its center to accommodate the portion of eyeball nozzle 10 comprising outlet holes 72 through which water arc 402 emanates from nozzle 10.

Figure 10:
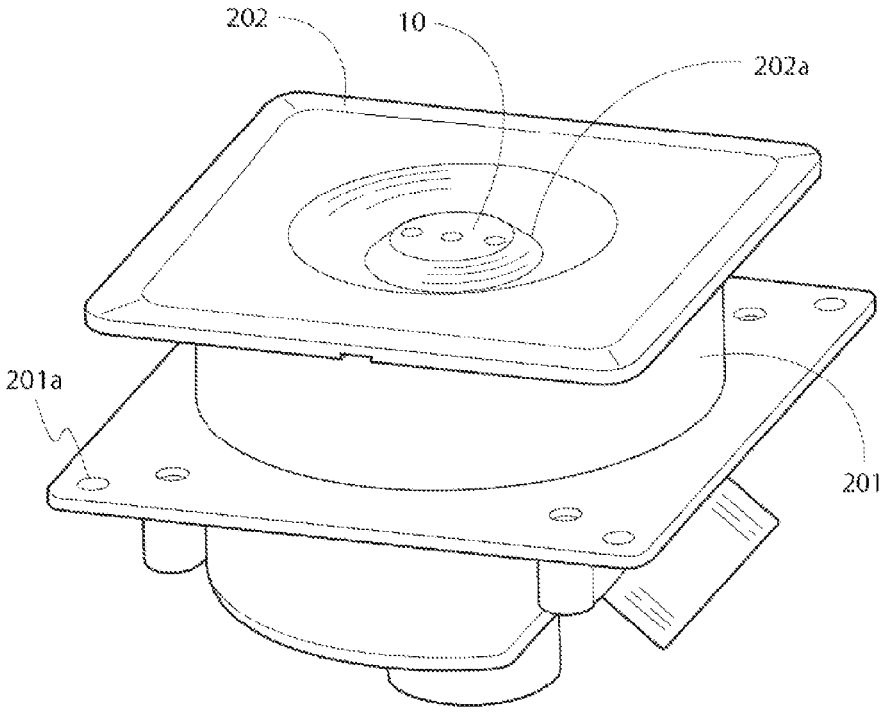
FIG. 10 illustrates the cover mounted above the plate.

FIG. 10 illustrates a preferred example of the system 200 in which the nozzle device 100 is mounted within jet body 201. Also shown is cover 202 disposed above and around the periphery of the water jet device 100 and jet body 201. Eyeball nozzle 10 has an upper surface that is located at a horizontal position approximately planar to the horizontal position of cover 202. Hence, the aesthetic design of the system 200 does not interfere with the owner's personal use and enjoyment of the deck or wall 300. In other words, cover 202 gives the system as a whole, a finished look.

FIG. 11 illustrates nozzle device 100 mounted on deck or wall 300 arcing a stream of water 402 into a water body 400. Nozzle 10 can be adjusted to alter or change the height and extent of the water arc 402. Likewise, by adjusting the flow of water though the device 100, the height and extent of the water arc 402 also can be adjusted or altered.

In operation, the device 100 provides an easily adjustable water arc 402 that can be directed at and in to a body of water 400. Jet body 201 can be a conventional or typical jet body for holding a water jet device 100. Jet body 201 can be mounted in a typical manner on the deck or wall 300 of or near a water receptacle 400. Often a recessed portion 301 is made in the deck or wall 300 to accommodate the jet body 201. Holes 201*a* through the top side of the jet body 201 flange secure the jet body 201 to the deck or wall 300. The holes 201*a* allow for installation in pool walls made with a fiberglass shell and also in pool walls made with a vinyl liner. Jet body 201 can be used in tandem with gaskets for fiberglass and vinyl liner pool installations. When installed in a concrete deck, jet body 201 flange helps secure jet body 201 in place in the concrete. Jet body 201 attaches to the conventional water supplying hardware for a typical water jet. Nozzle body 1 can be inserted into jet body 201 either before or after jet body 201 is attached to deck or wall 300. Nozzle body 1 securely but releasably attaches to jet body 201 via threaded area 1*a*. Handles 13 can be used to assist in this task. Water supply and/or water supplying hardware (not shown) cooperates with nozzle body 1 by supplying water to supply conduit 2.

Flow control plate 6 is securely and immovably attached within nozzle body 1, preferably between first section 22 and second section 24, and more preferably on shoulder 26. Nozzle seat 4 can be inserted into nozzle body 1 either before or after nozzle body is inserted into jet body 201, but preferably before. Nozzle seat 4 is structured such that bottom wall 7 is proximal to and cooperates with flow control plate 6, and more specifically such that nozzle seat holes 40 cooperate with flow control plate holes 60. Sponge 8 can be inserted into volume V created by inner wall 104 and cap 5 can be placed on the top (downstream) end of inner wall 104 to maintain sponge 8 within the volume V. Nozzle 10 can be inserted into nozzle seat and secured therein by lock ring 11. Lock ring 11 is designed to hold nozzle 10 within nozzle seat 4 such that nozzle 10 can still move pivotally and/or rotationally within nozzle seat 4. Cover 202 can be placed over the combined nozzle body 1, nozzle seat 4, and nozzle 10 structure so as to provide a finished appearance. Cover hole 202*a* should align with nozzle 10 to allow water to emanate from outlet holes 72.

Water is supplied to the device 100. If nozzle seat holes 40 align with, or at least partially align with, flow control plate holes 60, water can travel through the device 100 from first end 20 to second end 30 and create a water arc 402 to be directed into a water receptacle 400. Nozzle 10, if an eyeball nozzle 10 or another type of adjustable (movable, rotatable, pivotable, etcetera), can be adjusted to direct water arc 402 in a desired direction.

To adjust the water flow through the device 100, such as to increase, decrease, or stop the flow of water through the device 100, the user removes cover 202 and rotates nozzle seat 4. To accomplish this task, the user grasps nozzle seat 4, preferably at outer rim 56, and more preferably using protuberances 58 on outer rim 56, and rotates nozzle seat 4 clockwise or counterclockwise. Rotation of nozzle seat 4 relative to flow control plate changes the relation between nozzle seat holes 40 and flow control plate holes 60, thus causing an alignment, a partial alignment, or unalignment of holes 40, 60. Full alignment of holes 40, 60 results in maximum water flow through the device 100, full unalignment of holes 40, 60 results in minimum (or zero) water flow through the device 100, and partial alignment of holes 40, 60 results in a flow between the maximum and minimum flow rates depending on the selected level of alignment of holes 40, 60. Once the desired water flow rate is selected, cover 202 is replaced.

Accordingly, while the invention has been described with reference to the structures disclosed, it is not confined to the details set forth herein, but is intended to cover such modifications or changes that may fall within the spirit and scope of the invention.

LISTING OF THE ELEMENTS

Nozzle body
1*a* Threaded area
1*b* Upper end of nozzle
2 Supply conduit
4 Nozzle seat
4*a* First end of nozzle seat
4*b* Second end of nozzle seat
5 Cap
6 Flow control plate
7 Bottom wall of nozzle seat
8 Sponge
9 Seal ring/O-ring for nozzle seat
10 Nozzle eyeball
10*a* Upper surface of nozzle eyeball
11 Lock ring
12 O-ring for lock ring
13 Handles for nozzle seat
20 First end of device
22 First section of nozzle body
24 Second section of nozzle body
26 Shoulder on nozzle body
28 Third section of nozzle body
30 Second end of device
40 Nozzle seat holes
42 First section of nozzle seat
44 Second section of nozzle seat
52 Holes in cap
54 Retaining bars on cap
56 Outer rim of nozzle seat
58 Protuberances on outer rim
60 Flow control plate holes
72 Outlet holes
100 Water jet device
102 Outer wall of first section of nozzle seat
104 Inner wall of first section of nozzle seat
200 Water supply system
201 Jet body
201*a* Holes on top side of jet body
202 Cover
202*a* Hole through cover
300 Deck/wall of water receptacle
301 Recessed portion or cavity on deck/wall
400 Water receptacle
402 Water arc

What is claimed is:

1. An adjustable water jet device for controlling flow and direction of a water supply that is supplied to a water receptacle, said adjustable water jet device comprising:

a first end being an inlet and a second end being an outlet of said device;

a nozzle body extending in an axial direction of said device;

a nozzle seat rotatably disposed inside said nozzle body, said nozzle seat having a first section comprising a bottom wall proximal to the first end and a second section proximal to the second end, the bottom wall comprising at least one nozzle seat hole, and the bottom wall transversely disposed with respect to the axial direction of the device;

a flow control plate securely disposed between the first end and the bottom wall of the nozzle seat and proximal to the bottom wall of the nozzle seat, said flow control plate comprising at least one flow control plate hole, said flow control plate also transversely disposed with respect to the axial direction of the device; and a nozzle eyeball disposed within said second section of said nozzle seat for adjusting an angle of the water output from the second end of the device, said nozzle eyeball having an outlet disposed at an upper surface thereof at said second end of said device, wherein said nozzle seat is rotatable relative to said flow control plate such that said at least one nozzle seat hole rotates relative to said at least one flow control plate hole, whereby in a first position said at least one nozzle seat hole aligns fully with said at least one flow control plate hole thereby allowing a maximum flow of water through said device, in a second position said at least one nozzle seat hole does not align with said at least one flow control plate hole thereby allowing a minimum or zero flow of water through said device, and in a third position said at least one nozzle seat hole aligns partially with said at least one flow control plate hole thereby allowing a partial flow of water through said device between said the maximum flow and the minimum flow, said third position being any position between where said at least one nozzle seat hole aligns fully with said at least one flow control plate hole and said at least one nozzle seat hole does not align with said at least one flow control plate hole.

2. The water jet device according to claim 1, said nozzle seat further comprising:

a volume disposed within said first section of said nozzle seat between said bottom wall and said section section; and a means for reducing turbulence in the water flowing through said nozzle seat.

3. The water jet device according to claim 1, said nozzle seat further comprising:

a volume disposed within said first section of said nozzle seat between said bottom wall and said section section; and a means for filtering debris from the water flowing through said nozzle seat.

4. The water jet device according to claim 1, wherein said bottom wall of said nozzle seat includes a plurality of nozzle seat holes, each of said nozzle seat holes extending from a top edge to a bottom edge of said bottom wall, said nozzle seat holes being equidistant from one another.

5. The water jet device according to claim 4, wherein said flow control plate includes a plurality of flow control plate holes, each of said flow control plate holes extending from a top edge to a bottom edge of said flow control plate, said flow control plate holes being equidistant from one another.

6. The water jet device according to claim 1, further comprising at least one lock ring attached to said nozzle seat to retain said nozzle eyebal within said nozzle seat.

7. The water jet device according to claim 1, further comprising a plurality of handles perpendicularly extending from an outer wall of said nozzle body for facilitating insertion and removal of said nozzle body from said device.

8. The water jet device according to claim 1, further comprising a plurality of protuberances extending from an outer rim of said nozzle seat for facilitating rotation of said nozzle seat relative to said flow control plate.

* * * * *